US005795096A

United States Patent [19]

Culver

[11] Patent Number: 5,795,096

[45] Date of Patent: Aug. 18, 1998

[54] ROAD RESURFACING SYSTEM

[75] Inventor: Larry G. Culver, Sherwood Park, Canada

[73] Assignee: LCI International Inc., Sherwood Park, Canada

[21] Appl. No.: 708,827

[22] Filed: Sep. 9, 1996

[51] Int. Cl.[6] ..... E01C 21/00

[52] U.S. Cl. ..... 404/90; 404/92; 172/178; 172/579

[58] Field of Search ..... 404/90, 91, 92, 404/81, 101, 122, 128; 299/39.9; 172/49, 105, 106, 175, 178, 540, 574, 579, 703, 68, 69

[56] References Cited

U.S. PATENT DOCUMENTS

| | | | |
|---|---|---|---|
| 978,427 | 12/1910 | Bankhead | 172/69 |
| 1,058,841 | 4/1913 | Boyd | 172/703 |
| 1,074,729 | 10/1913 | Moody | 172/703 |
| 1,523,084 | 1/1925 | Scheunemann | 404/90 |
| 1,537,771 | 5/1925 | Harris | 172/178 |
| 1,938,023 | 12/1933 | Ingalls | 404/90 |
| 2,134,245 | 10/1938 | Carswell | 404/90 |
| 2,138,904 | 12/1938 | Carswell | 404/90 |
| 2,591,851 | 4/1952 | Milla | 172/178 |
| 2,635,403 | 4/1953 | Gandrud | 404/90 X |
| 2,729,929 | 1/1956 | Mason | 172/579 |
| 2,787,943 | 4/1957 | Browning . | |
| 2,925,870 | 2/1960 | Michelsen et al. | 404/122 X |
| 3,094,315 | 6/1963 | Yetter | 404/90 |
| 3,496,844 | 2/1970 | Evans | 404/92 |
| 3,508,617 | 4/1970 | Paynter | 172/68 |
| 3,739,859 | 6/1973 | White | 172/178 X |
| 3,993,413 | 11/1976 | Cox et al. | 404/128 |
| 4,300,853 | 11/1981 | Jones | 404/92 |
| 4,450,916 | 5/1984 | Francis | 172/147 |
| 4,454,920 | 6/1984 | Dietrich, Sr. | 172/464 |
| 4,784,518 | 11/1988 | Cutler | 404/79 |
| 5,020,604 | 6/1991 | Peck | 172/177 |
| 5,108,221 | 4/1992 | Skibsted | 404/128 |

OTHER PUBLICATIONS

Abstract of U.S. Patent No. 4,607,706, Aug. 26, 1986, Raynor, 2 pages.

Abstract of U.S. Patent No. 5,108,221, Skibsted, Apr. 28, 1992, 2 pages.

Abstract of U.S. Patent RE No. 34,860, Skibsted, Apr. 14, 1995, Re-issue of U.S. Patent No. 5,197,820, 2 pages.

Abstract of U.S. Patent No. 5,407,013, Scott, Apr. 18, 1995, 1 page.

Abstract of U.S. Patent No. 5,407,014, Tranmer, Apr. 18, 1995, 1 page.

Abstract of U.S. Patent No. 5,265,975, Scott, Nov. 30, 1993, 1 page.

Abstract of U.S. Patent No. 5,106,165, Lattman, Apr. 21, 1992, 1 page.

*Primary Examiner*—James Lisehora

*Attorney, Agent, or Firm*—Anthony R. Lambert

[57] ABSTRACT

A road resurfacing device has a frame on which is mounted a ripper bar for ripping the road surface, to a controlled depth, and behind it a separator for separating coarse and fine material in the road surface such the coarse material is deposited on fine material. The frame is supported by rollers extending across the frame. The ripper bar has depending teeth in rows on both sides of the ripper bar and is rotatable so that either sets of teeth, which may be at different heights, rip the road surface. The separator is formed of ground turning discs mounted on angled shafts to direct material first to one side and then to the other. The ground turning discs rotate counter to the direction of movement of the frame. A method of resurfacing a gravel road includes ripping the surface of the gravel road to break up fine and coarse material near the surface of the gravel road; and separating coarse material from fine material such that coarse material is deposited on top of the fine material. The road may then be graded. The depth of rip is controlled to rip up gravel and not penetrate the sub-surface of the gravel road. The ripping and separation functions are achieved by moving the road resurfacing device of the invention across a gravel road behind, in front of or under a grader or tractor.

19 Claims, 7 Drawing Sheets

ROAD RESURFACING SYSTEM

FIELD OF THE INVENTION

This invention relates to devices and methods for the resurfacing of roads, particularly gravel roads.

BACKGROUND OF THE INVENTION

In the art of road resurfacing, gravel roads often need replacement gravel as the coarse material tends to migrate downward, leaving slippery mud and organic matter on the surface. Usually, additional gravel is placed on the road, and the road is then graded. Some gravel also migrates off the road, and a system has been proposed in U.S. Pat. No. 5,108,221 for returning that gravel to the road. So far as the inventor is aware, however, no system has been successfully used or proposed for the recovery of gravel in the road surface.

SUMMARY OF THE INVENTION

There is therefore provided in accordance with one embodiment of the invention, a road resurfacing device that includes a frame on which is mounted a ripper bar for ripping the road surface, preferably to a controlled depth, and behind it a separator for separating coarse and fine material in the road surface such the coarse material is deposited on fine material. The frame is supported by ground engaging supports, preferably rollers extending across the frame.

The ripper bar preferably has depending teeth in rows on both sides of the ripper bar and is rotatable so that either sets of teeth, which may be at different heights, rip the road surface.

The separator is preferably formed of ground turning discs mounted on angled shafts to direct material first to one side and then to the other. The ground turning discs preferably rotate counter to the direction of movement of the frame.

In a method of resurfacing a gravel road, there are provided the steps of ripping the surface of the gravel road to break up fine and coarse material near the surface of the gravel road; and separating coarse material from fine material such that coarse material is deposited on top of the fine material. The road may then be graded. The depth of rip is controlled to rip up gravel and not penetrate the sub-surface of the gravel road. Preferably, the ripping and separation functions are achieved by moving the road resurfacing device of the invention across a gravel road behind, in front of or under a grader or tractor.

There is also provided according to a still further aspect of the invention a method of resurfacing an icy road in which the ice is first ripped and then broken into smaller fragments. The smaller fragments may be moved to one side and removed by a grader.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
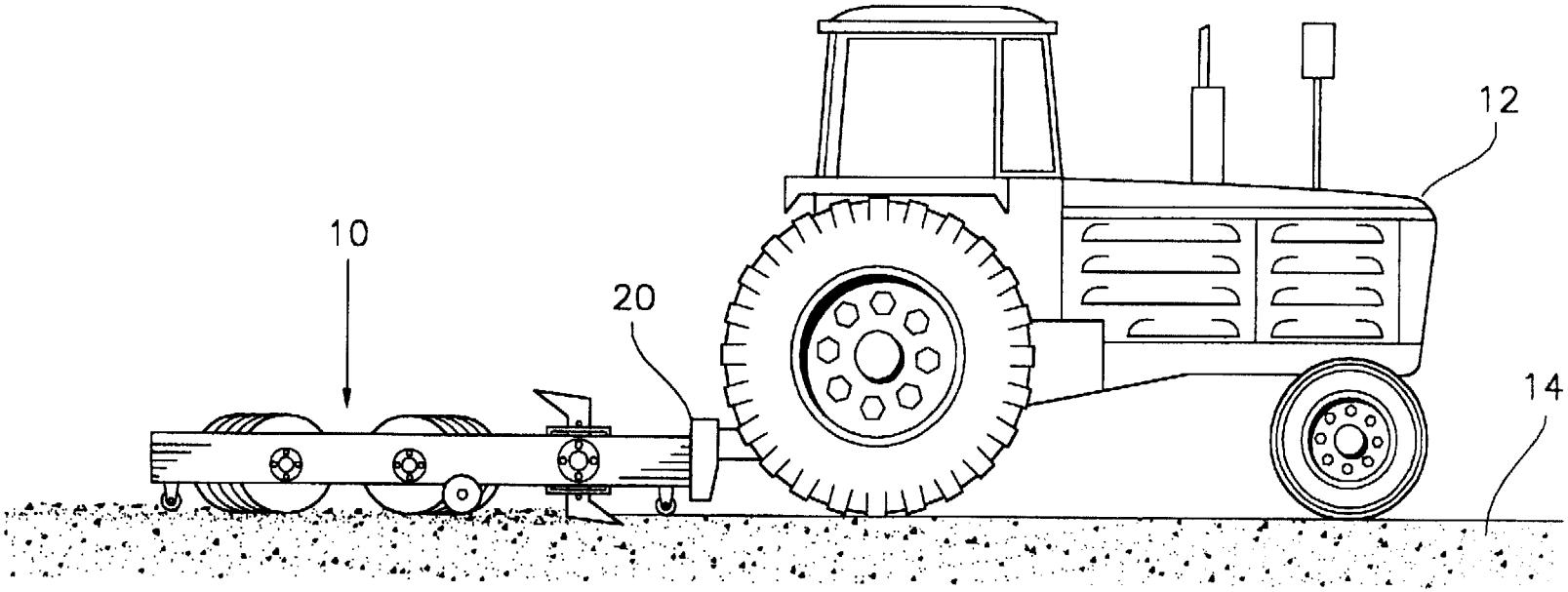
FIG. 1 is a side view of a tractor pulling a device constructed according to the invention on a road surface.
Figure 2:
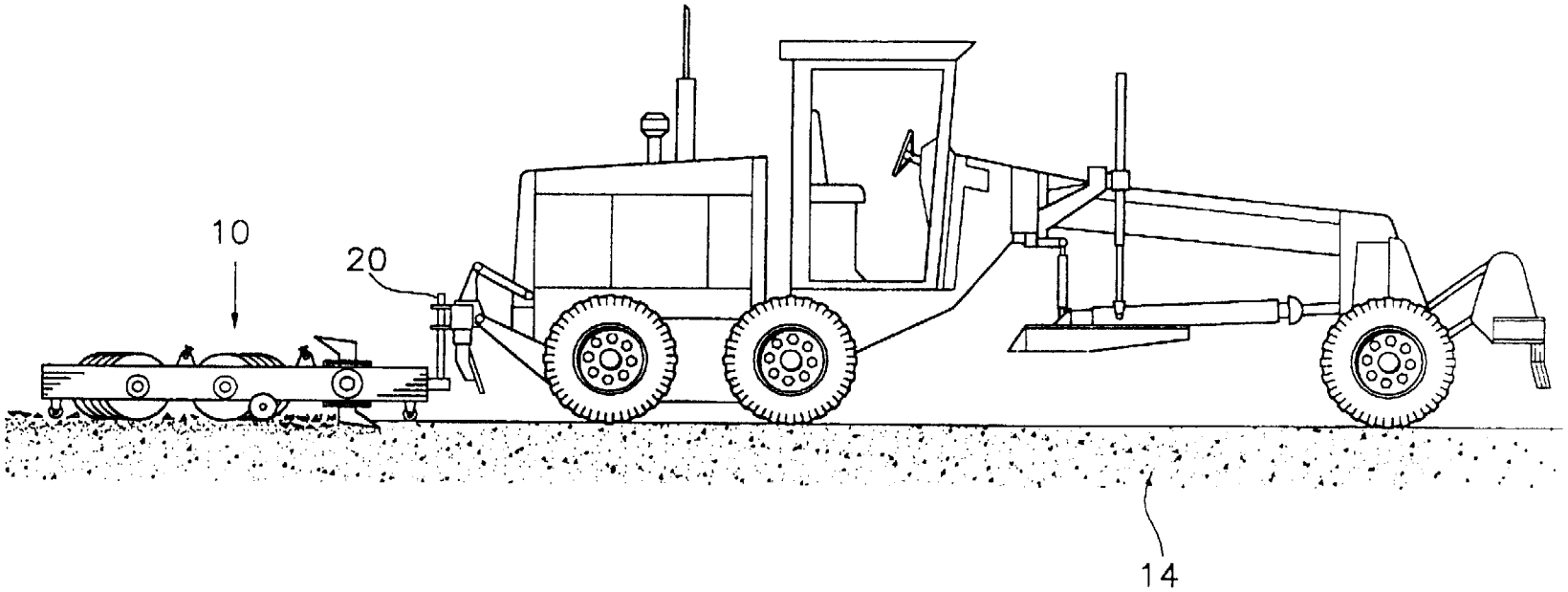
FIG. 2 is a side view of a grader pulling a device constructed according to the invention on a road surface.
Figure 2A:
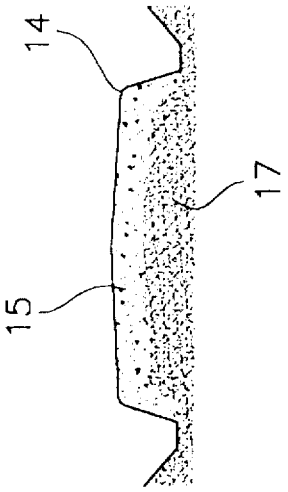
FIG. 2A is a section through an exemplary roadway on which a road resurfacing device according to the invention may be used.
Figure 3:
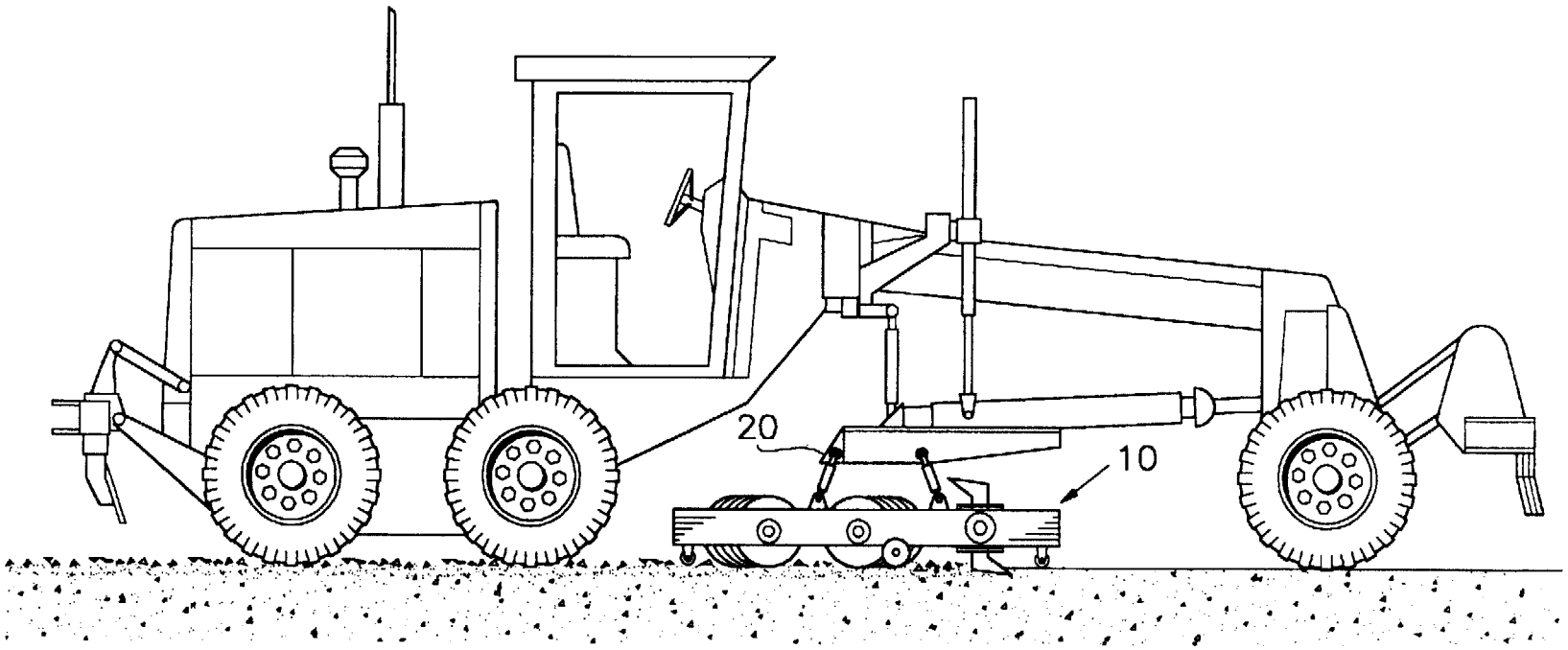
FIG. 3 is a side view of a grader equipped with a device constructed according to the invention fixed to the middle hydraulics of the grader.

Referring to Figs. 1, 2 and 3, the road resurfacing device 10 according to the invention may be towed behind a tractor 12 on a road 14, towed behind a grader 16, or mounted on the grader hydraulics 18 on the underside of the grader 16. Other mounting and/or towing methods may be used. For mounting on a vehicle such as the tractor 12 or grader 16, the road resurfacing device 10 may include a three point hitch, tow bar or other device 20 for attaching the road resurfacing device 10 to the vehicle. The road 14 may be considered to comprise a surface 15 that is predominantly fine and coarse material including gravel, sand and mud, and a sub-surface 17 predominantly composed of finer material. In practice, the configuration of the road will vary, and in particular the depth of the gravel layer will vary. Typically, however, the gravel layer will need to be worked to a depth of between about ½and 4 inches, for example about 2 inches.

Figure 4:
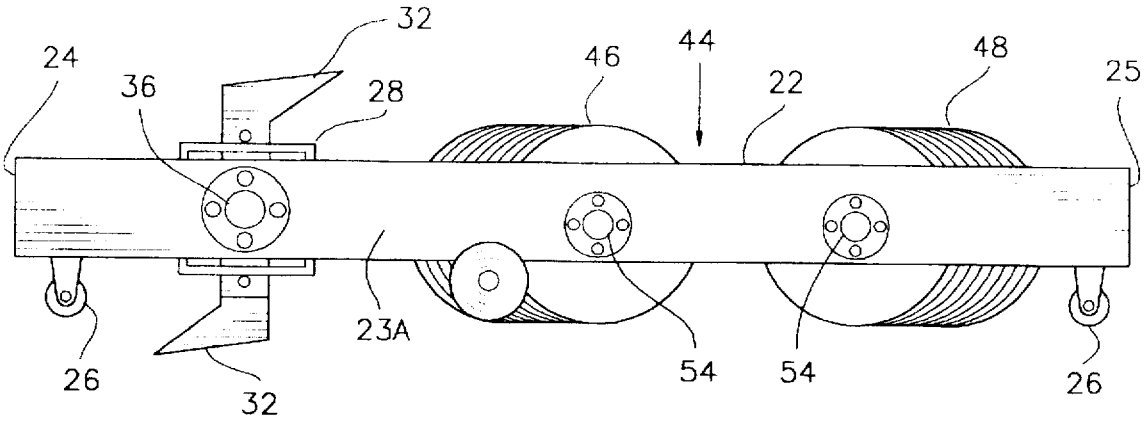
FIG. 4 is a side view of a device constructed according to the invention including discs and ripper bar.
Figure 5:
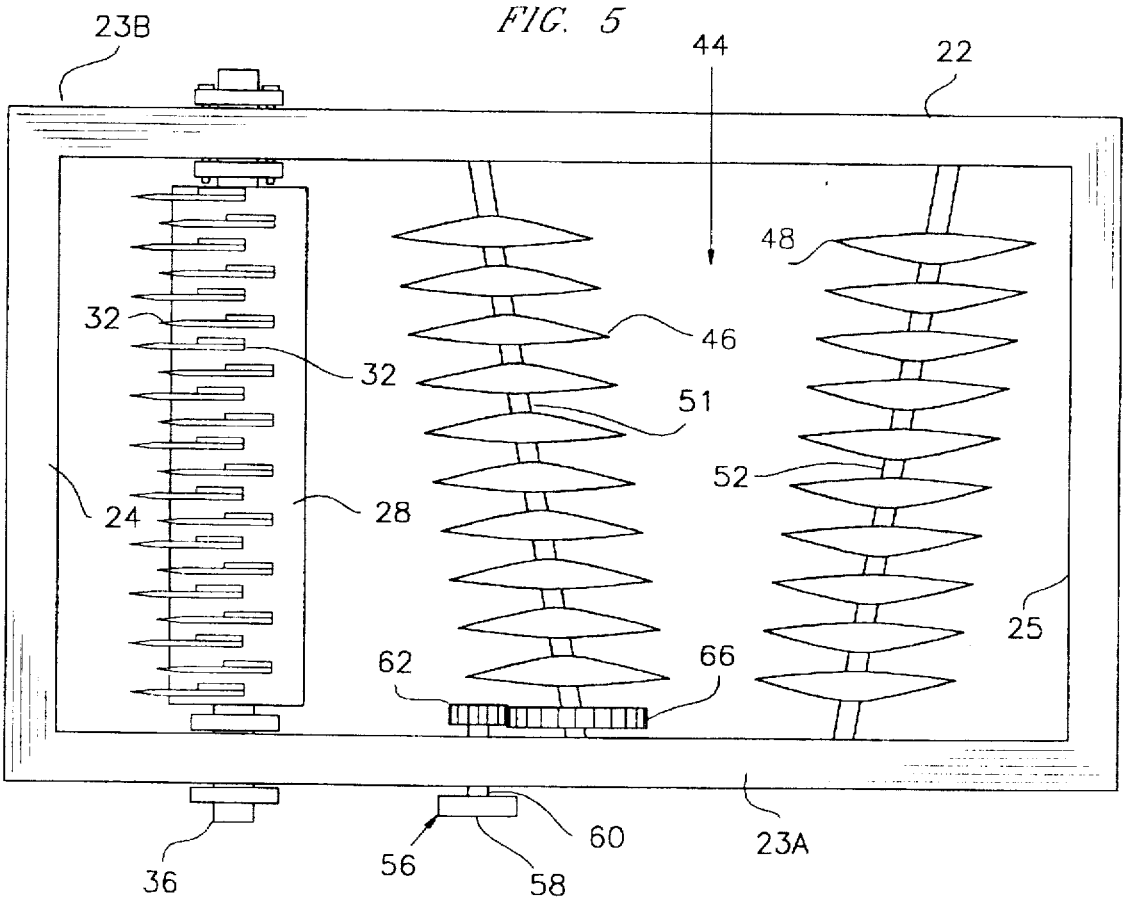
FIG. 5 is a plan view of a device constructed according to the invention.
Figure 10:
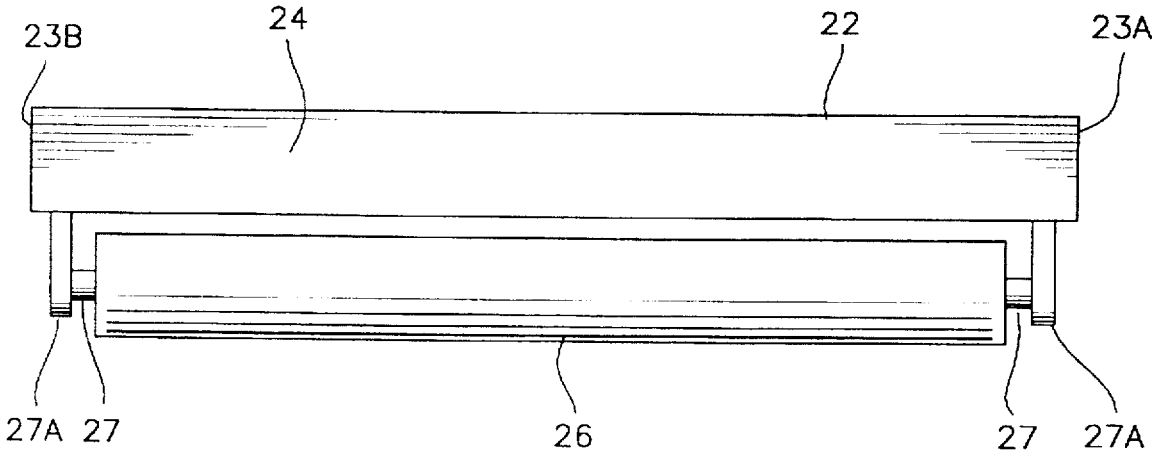
FIG. 10 is an end view of a ground engaging support for the road resurfacing device according to the invention.

The road resurfacing device 10 is best shown in FIGS. 4 and 5 and is formed from a frame 22 having a left side 23A, right side 23B, front end 24 and back end 25. Ground engaging supports 26 are provided at least at each of the front and back ends 24 and 25 for supporting the frame on the ground. Preferably, as shown in FIG. 10, the ground engaging supports 26 are rollers, such as are used on grass mowers mounted on a shaft 27, which itself is fixed to supports 27A depending from the frame 22. Use of rollers, or other rolling devices that are spread out laterally across the front and back ends of the frame 22, helps to maintain the frame 22 at a constant elevation above the road 14 and prevent the teeth 32 from ripping too deeply.

Figure 6:
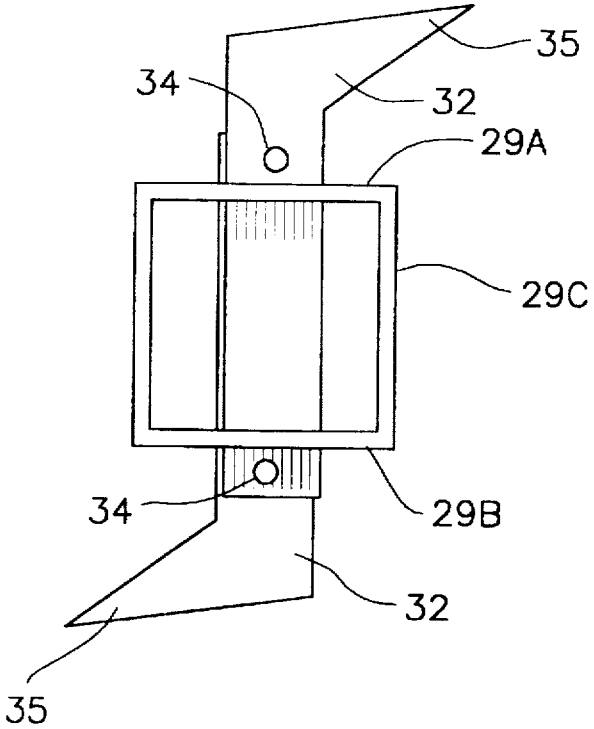
FIG. 6 is a side view of teeth used with the ripper bar of FIGS. 4 and 5.

The frame 22 has a ripper bar 28 extending from the left side 23A to the right side 23B. The ripper bar 28 may be a square tube as shown in FIG. 6, and has plural depending teeth 32 extending through suitable holes in the ripper bar 28. The teeth 32 are spaced along the ripper bar 28, preferably extending from both sides 29A and 29B of the ripper bar as shown in FIG. 4, and preferably mounted in two rows on each side of the ripper bar 28 as shown in FIG.

Figure 6A:
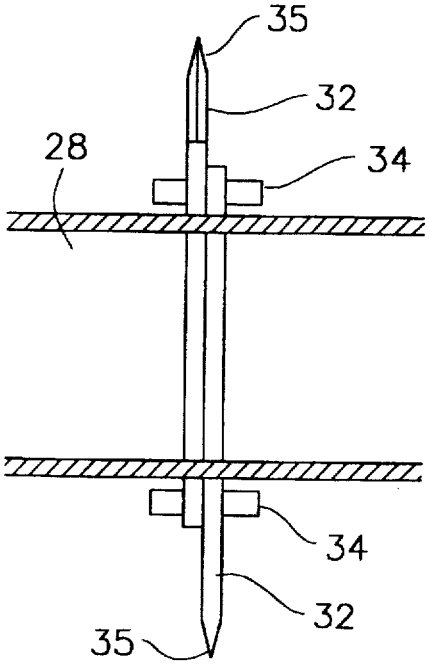
FIG. 6A is an end view of teeth used with the ripper bar of FIGS. 4 and 5 (at a right angle to the view direction in each of FIGS. 5 and 6.
Figure 7:
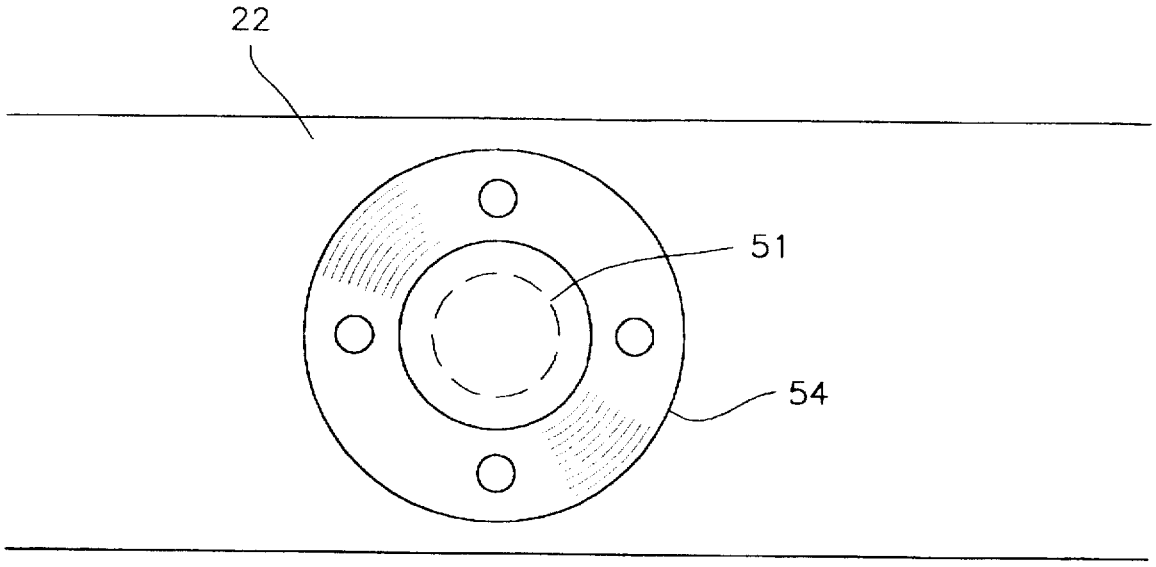
FIG. 7 is a side view showing a mounting mechanism for the discs shown in FIGS. 4 and 5.

5 such that teeth in the first row are closer to the front than those in the second row. The teeth 32 on one side 29A are preferably longer than the teeth 32 on the other side 29B, thus permitting the depth of rip to be selected depending on which set of teeth engages the ground. The spacing may be in the order of 6 inches in each row, so that there is a tooth 32 about every 3 inches along the ripper bar. The teeth 32 extend about 4 inches out from the ripper bar, and opposed teeth 32 are preferably fastened to each other as shown in FIGS. 6 and 6A with pins 34. The teeth 32 may be L-shaped as shown in FIG. 6, with points 35, that in use, are oriented in a forward direction on the frame 22.

The ripper bar 28 is preferably mounted so that either one of the opposed sets of teeth, on either side of the ripper bar 28, may engage the ground. The ripper bar 28 could include additional rows of teeth, for example on side 29C. To allow either one of the sets of teeth 32 to be moved into ground engaging position, the ripper bar 28 is mounted on a shaft 36 defining a longitudinal axis of the ripper bar 28 and journalled in each side of the frame 22. Pins 38 which are received by holes 39 in the frame 22 and holes in flanges 40 on the shaft 36 hold the ripper bar 28 in one fixed position on the frame 22. The pins 38 are secured as for example by split rings 42. To rotate the ripper bar 28, the split rings 42 are removed from the pins 38, the pins 38 are removed from the frame 22, and the shaft 34 is rotated to the desired position. The pins 34 are then replaced and secured with the split rings 42.

A separator 44 is also mounted on the frame 22 and extends laterally across the frame 22 between the sides 23A and 23B. The separator 36 is located nearer to the back end than the ripper bar 28. The function of the separator 44 is to separate fine material from coarse material ripped up by the ripper bar 28. The separator 44 is preferably formed from first and second sets of ground turning discs 46 and 48 mounted respectively and behind one another on shafts 51 and 52. The discs 46, 48 are spaced about 6inches apart from each other along the shafts 51, 52. Each shaft 51, 52 is supported in a journal 54, one for each shaft 51, 52 on each side of the frame 22. The shafts 51, 52 are preferably mounted at an angle to each other and to the direction of travel of the frame 22. The direction of travel in this case is parallel to the sides 23A and 23B. The angle of the discs 46, 48 on the shafts 51, 52 is preferably adjustable from about 5° to 20° and is preferably about 10°. The discs 46, 48 may be ground turning discs commonly employed in farming for turning over soil. Due to the hardness of the road beds, it is preferred that the discs have hardened edges or be made of very hard steel to prevent premature wear.

The first set of ground turning discs 46 are preferably mounted to direct material towards the right side of the frame 22 (opposite to that shown in the Figure) and the second set of ground turning discs 48 are mounted to direct material towards the left side of the frame 22.

Figure 8:
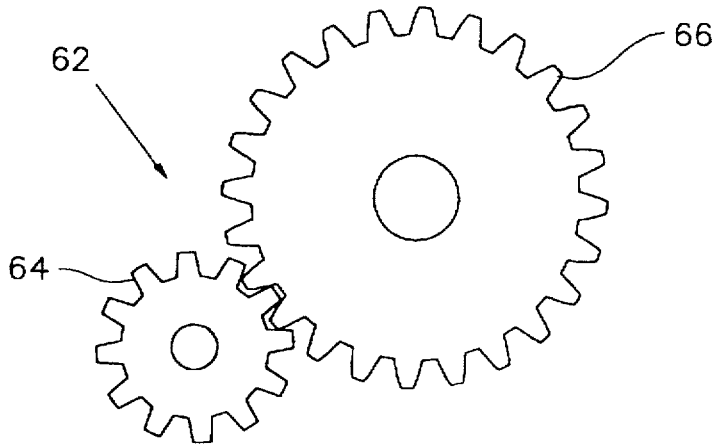
FIG. 8 is a side view of a gear system for rotating the discs shown in FIGS. 4 and 5.
Figure 9:
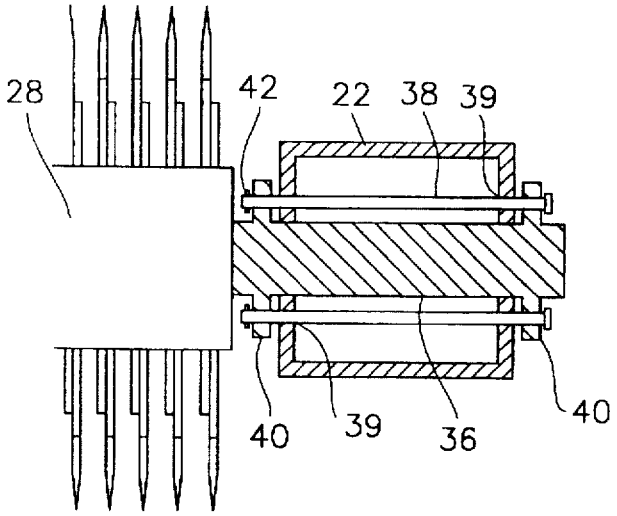
FIG. 9 is a longitudinal section through a mounting mechanism for the ripper bar shown in FIGS. 4 and 5.

Each end of each shaft 51, 52 is preferably supplied with a gear or like system 56 for rotating the shafts 51, 52, only one of which gear systems being shown. Each gear system 56 includes a ground engaging wheel 58 on a shaft 60 mounted in the frame 22 and a reversing gear 62 linking the ground engaging wheel 58 to the shaft 51 or 52 such that the shaft 51 or 52 rotates in the opposite direction to the ground engaging wheel 58. The reversing gear 62, best seen in FIG. 8 is formed from a first toothed disc 64 mounted on the shaft 60 that engages second toothed disc 66 mounted on the shaft 51 or 52. The backward rotation of the discs 46, 48 assists in separating fine material from coarse material.

The road resurfacing device is used to resurface a gravel road as follows, where the gravel road surface includes fine material (sand, mud and organic matter) and coarse material. The road resurfacing device with ripper bar 28 and separator 44 is towed or otherwise moved across the road surface by a vehicle, such as a tractor or grader, behind, in front of or underneath the tractor or grader. It is believed particularly advantageous to mount the road resurfacing device on the hydraulics on the underside of the grader in order to allow precise control of the depth of rip. In operation, the road resurfacing device works as follows. First, the surface of the gravel road is ripped by the ripper bar to break up fine and coarse material near the surface of the gravel road and then coarse material is separated from fine material by the separator such that coarse material is deposited on top of the fine material. The separation action is provided by the discs moving the ground surface material first to one side (preferably the outside) and then to the other side (preferably the inside). Outside and inside are defined in relation to the road, the inside being approximately the center of the road. Not all coarse material will end up on top of all of the fine material, but the more that does so, the better. After separation, the road may not need grading, but it is preferable that the road be then graded to provide a graded contour to the road surface.

The depth of rip should be controlled to rip up gravel and not penetrate the sub-surface of the gravel road. The ground turning discs are preferably rotated in a direction opposed to the direction of travel of the frame over the ground. The frame should be heavy to ensure that the teeth rip to the desired depth, and may be weighted by weights placed on the frame to assist in controlling the depth of rip.

The frame is about 8 feet wide. It is important not to rip too deeply, since the object is to move larger sized material to the surface and not dig up fine material. For this purpose the rollers 26 or some other means to prevent the frame 22 from digging in too deeply should be used and to maintain the teeth 32 at a constant insertion depth across the width of the road resurfacing device. An example of another support means is to suspend the frame 22 from the underside of a grader as in FIG. 3. However, even in the case of the embodiment shown in FIG. 3, it is preferred that ground engaging supports 26 be used.

The road resurfacing device 10 may be also used on icy roads to break up thin layers of ice. The teeth of the ripper bar 28 rip the ice into pieces, and then the tandem discs or separator 44 (two sets of discs as shown in FIG. 5) break the ice into smaller fragments. The tandem discs preferably move the ice first to the inside of the road, and then to the outside where it may be removed by a grader.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A road resurfacing device, comprising:

a frame having first and second sides and a front end and a back end;

ground engaging supports at least at each of the front and back ends for supporting the frame on the ground;

a ripper bar extending from the first sire to the second side, the ripper bar having plural depending teeth spaced along the ripper bar;

a separator extending from the first side to the second side and located nearer to the back end than the ripper bar for separating fine material from coarse material ripped up by the ripper bar;

the separator comprising a first set of ground turning discs mounted on a first shaft, the first shaft being mounted for rotation on the frame;

first shaft rotation means to rotate the first shaft in a direction of travel opposed to the direction of travel of the frame over the ground; and means to attach the frame to a vehicle.

2. The road resurfacing device of claim 1 in which the ground engaging supports comprise:

a first roller at the front end of the frame; and a second roller at the back end of the frame.

3. The road resurfacing device of claim 2 in which each of the first and second rollers extends from the first side to the second side of the frame.

4. The road resurfacing device of claim 1 in which the ripper bar includes first and second sets of teeth extending along the ripper bar and the ripper bar is movable from a first position in which the first set of teeth engages the ground to a second position in which the second set of teeth engages the ground.

5. The road resurfacing device of claim 4 in which the first set of teeth extend further outward from the ripper bar than the second set of teeth.

6. The road resurfacing device of claim 4 in which the ripper bar has a longitudinal axis and the ripper bar is rotatable about the longitudinal axis from the first position to the second position.

7. The road resurfacing device of claim 1 in which the separator further comprises:

a second set of ground turning discs mounted on a second shaft rearward of the first set of ground turning discs.

8. The road resurfacing device of claim 7 in which the first and second shafts are mounted at an angle to each other.

9. The road resurfacing device of claim 7 in which the first set of ground turning discs are mounted to direct material towards the first side of the frame and the second set of ground turning discs are mounted to direct material towards the second side of the frame.

10. The road resurfacing device of claim 1 in which the first shaft rotation means comprises:

a ground engaging wheel; and a reversing gear linking the ground engaging wheel to the shaft such that the shaft rotates in the opposite direction to the ground engaging wheel.

11. The road resurfacing device of claim 1 in combination with a grader having a rearward end, the frame being connected to the rearward end of the grader.

12. The road resurfacing device of claim 11 in which the grader includes a grading blade.

13. The road resurfacing device of claim 1 in combination with a grader having hydraulics for raising and lowering devices connected to the underside of the grader, the frame being mounted on the hydraulics and connected to the underside of the grader.

14. The road resurfacing device of claim 1 in combination with a tractor, the frame being mounted for towing behind the tractor.

15. The road resurfacing device of claim 1 in which the teeth are spaced along the ripper bar with some teeth closer to the front end of the frame than other teeth.

16. A road resurfacing device, comprising:

a frame having first and second sides and a front end and a back end;

ground engaging supports at least at each of the front and back ends for supporting the frame on the ground;

a ripper bar extending from the first side to the second side, the ripper bar having plural depending teeth spaced along the ripper bar;

a separator extending from the first side to the second side and located nearer to the back end than the ripper bar for separating fine material from coarse material ripped up by the ripper bar;

the separator comprising a first set of ground turning discs mounted on a first shaft and a second set of ground turning discs mounted on a second shaft rearward of the first set of ground turning discs; and means to attach the frame to a vehicle.

17. The road resurfacing device of claim 16 in which the first and second shafts are mounted at an angle to each other.

18. The road resurfacing device of claim 16 in which the first set of ground turning discs arc mounted to direct material towards the first side of the frame and the second set of ground turning discs are mounted to direct material towards the second side of the frame.

19. The road resurfacing device of claim 16 in which discs of the second set of ground turning discs are laterally offset from discs of the first set of ground turning discs.

* * * * *